US008807736B1

(12) United States Patent
Walker et al.

(10) Patent No.: US 8,807,736 B1
(45) Date of Patent: Aug. 19, 2014

(54) LOW-TEMPERATURE GAS FLOW INSERTION IN PRINTING SYSTEM DRYERS

(71) Applicants: Casey E. Walker, Boulder, CO (US); Scott Johnson, Erie, CO (US); Stuart J. Boland, Denver, CO (US); William Edward Manchester, Erie, CO (US); Sean K. Fitzsimons, Thornton, CO (US)

(72) Inventors: Casey E. Walker, Boulder, CO (US); Scott Johnson, Erie, CO (US); Stuart J. Boland, Denver, CO (US); William Edward Manchester, Erie, CO (US); Sean K. Fitzsimons, Thornton, CO (US)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/755,701

(22) Filed: Jan. 31, 2013

(51) Int. Cl.

| | |
|---|---|
| ***B41J 2/01*** | (2006.01) |
| ***B41F 23/04*** | (2006.01) |
| ***B41J 29/377*** | (2006.01) |
| ***B41J 11/00*** | (2006.01) |
| *B41J 2/14* | (2006.01) |

(52) U.S. Cl.
CPC ..... *B41F 23/044* (2013.01); *B41J 29/377* (2013.01); *B41J 2/1408* (2013.01); *B41J 11/002* (2013.01); *B41J 2202/08* (2013.01)
USPC ..... 347/102; 347/16; 347/17; 347/18; 347/101

(58) Field of Classification Search
CPC .... B41J 11/002; B41J 29/377; B41J 2202/08; B41J 2/1408; B41F 23/044
USPC ..... 347/102, 101, 16, 17, 18, 19
See application file for complete search history.

(56) References Cited

U.S. PATENT DOCUMENTS

| | | | | |
|---|---|---|---|---|
| 5,502,788 | A | 3/1996 | Platsch | |
| 5,537,925 | A | 7/1996 | Secor et al. | |
| 6,508,550 | B1 | 1/2003 | Eastlund | |
| 6,854,842 | B2 | 2/2005 | Martin et al. | |
| 6,983,696 | B2 | 1/2006 | Koch et al. | |
| 7,591,224 | B2 | 9/2009 | Bock | |
| 7,966,743 | B2 * | 6/2011 | Piatt et al. | 34/82 |
| 8,328,321 | B2 | 12/2012 | Tsuzawa | |
| 2007/0079719 | A1 | 4/2007 | Rohde | |
| 2007/0153074 | A1 | 7/2007 | Anderson et al. | |
| 2010/0188469 | A1 * | 7/2010 | Ikegami | 347/102 |

* cited by examiner

*Primary Examiner* — Henok Legesse
(74) *Attorney, Agent, or Firm* — Duft Bornsen & Fettig LLP

(57) ABSTRACT

Systems and methods are provided for inserting low temperature gas into dryers of printing systems. The system comprises a dryer, which includes a heating element and a flow generator. The heating element is within an interior of the dryer and is able to heat a web of printed media as the web travels through the interior. The flow generator is within the interior and is operable to directly project an impinging jet of gas along a width of the web that deflects heated air proximate to the web. The gas is cooler than the heated air.

18 Claims, 9 Drawing Sheets

LOW-TEMPERATURE GAS FLOW INSERTION IN PRINTING SYSTEM DRYERS

FIELD OF THE INVENTION

The invention relates to the field of dryers, and in particular, to dryers for systems such as continuous-forms printing systems.

BACKGROUND

Businesses or other entities having a need for volume printing typically purchase a production printer. A production printer is a high-speed printer used for volume printing (e.g., one hundred pages per minute or more). The production printers are typically continuous-form printers that print on webs of print media that are stored on large rolls.

A production printer typically includes a localized print controller that controls the overall operation of the printing system, and a print engine (sometimes referred to as an "imaging engine" or as a "marking engine"). The print engine includes one or more printhead assemblies, with each assembly including a printhead controller and a printhead (or array of printheads). An individual printhead includes multiple tiny nozzles (e.g., 360 nozzles per printhead depending on resolution) that are operable to discharge ink as controlled by the printhead controller. A printhead array is formed from multiple printheads that are spaced in series across the width of the print media.

When in operation, the web of print media is quickly passed underneath the printhead arrays while the nozzles of the printheads discharge ink at intervals to form pixels on the web. Some types of media used in inkjet printers are better suited to absorb the ink, while other types are not. Thus, a radiant dryer may be installed downstream from the printer. The radiant dryer assists in drying the ink on the web after the web leaves the printer. A typical radiant dryer includes an array of lamps that emit light and heat. The light and heat from the lamps helps to dry the ink as the web passes through the dryer.

Even though a web of print media moves quickly through the dryer, a web still has a chance of scorching or burning when it travels through the dryer. This is because marked portions of the web, which are darker, will absorb more radiant infrared energy from the dryer than un-marked, blank portions of the web. When the marked portions absorb more radiant energy, they increase in temperature much faster than the blank portions, and this causes the increased fire risk. Furthermore, the uneven distribution of heat to the various portions of the web can cause permanent warping and distortion in the web itself, which is undesirable to users of the printing system.

SUMMARY

Embodiments described herein include a flow generator placed within a dryer of a printing system. The flow generator projects a jet of impinging gas directly onto the web, which disrupts air within the dryer that is proximate to the web. The impinging gas is cool with respect to the air within the dryer (e.g., at ambient room temperature or cooler). Therefore, the projected gas cools the heated web. Because marked portions of the web are hotter than unmarked portions, the marked portions of the web lose more heat to the cool gas than the unmarked portions, and the temperature difference between the marked and unmarked portions of the web are reduced. This prevents the web from scorching or burning.

One embodiment is a dryer of a printing system that includes a heating element and a flow generator. The heating element is within an interior of the dryer and is able to heat a web of printed media as the web travels through the interior. The flow generator is within the interior and is able to directly project an impinging jet of gas along a width of the web that deflects heated air proximate to the web. The gas is cooler than the heated air.

Another embodiment is a flow generator that includes a nozzle and a gas source. The gas source is able to force gas through the nozzle. The nozzle is located within an interior of a dryer and is able to directly project an impinging jet of cool gas along a width of a web of printed media within the dryer. The gas is cooler than heated air within the interior and deflects heated air proximate to the web.

Another embodiment is a method for operating a dryer of a printing system. The method includes driving a web of printed media through an interior of a dryer, and operating a heating element within the interior of the dryer to heat the web as the web travels through the interior. The method also includes projecting an impinging jet of cool gas directly along a width of the web within the interior and deflecting heated air proximate to the web. The gas is cooler than heated air within the interior.

Other exemplary embodiments (e.g., methods and computer-readable media relating to the foregoing embodiments) may be described below.

DESCRIPTION OF THE DRAWINGS

Some embodiments of the present invention are now described, by way of example only, and with reference to the accompanying drawings. The same reference number represents the same element or the same type of element on all drawings.

DETAILED DESCRIPTION

The figures and the following description illustrate specific exemplary embodiments of the invention. It will thus be appreciated that those skilled in the art will be able to devise various arrangements that, although not explicitly described or shown herein, embody the principles of the invention and are included within the scope of the invention. Furthermore, any examples described herein are intended to aid in understanding the principles of the invention, and are to be construed as being without limitation to such specifically recited examples and conditions. As a result, the invention is not limited to the specific embodiments or examples described below, but by the claims and their equivalents.

Figure 1:
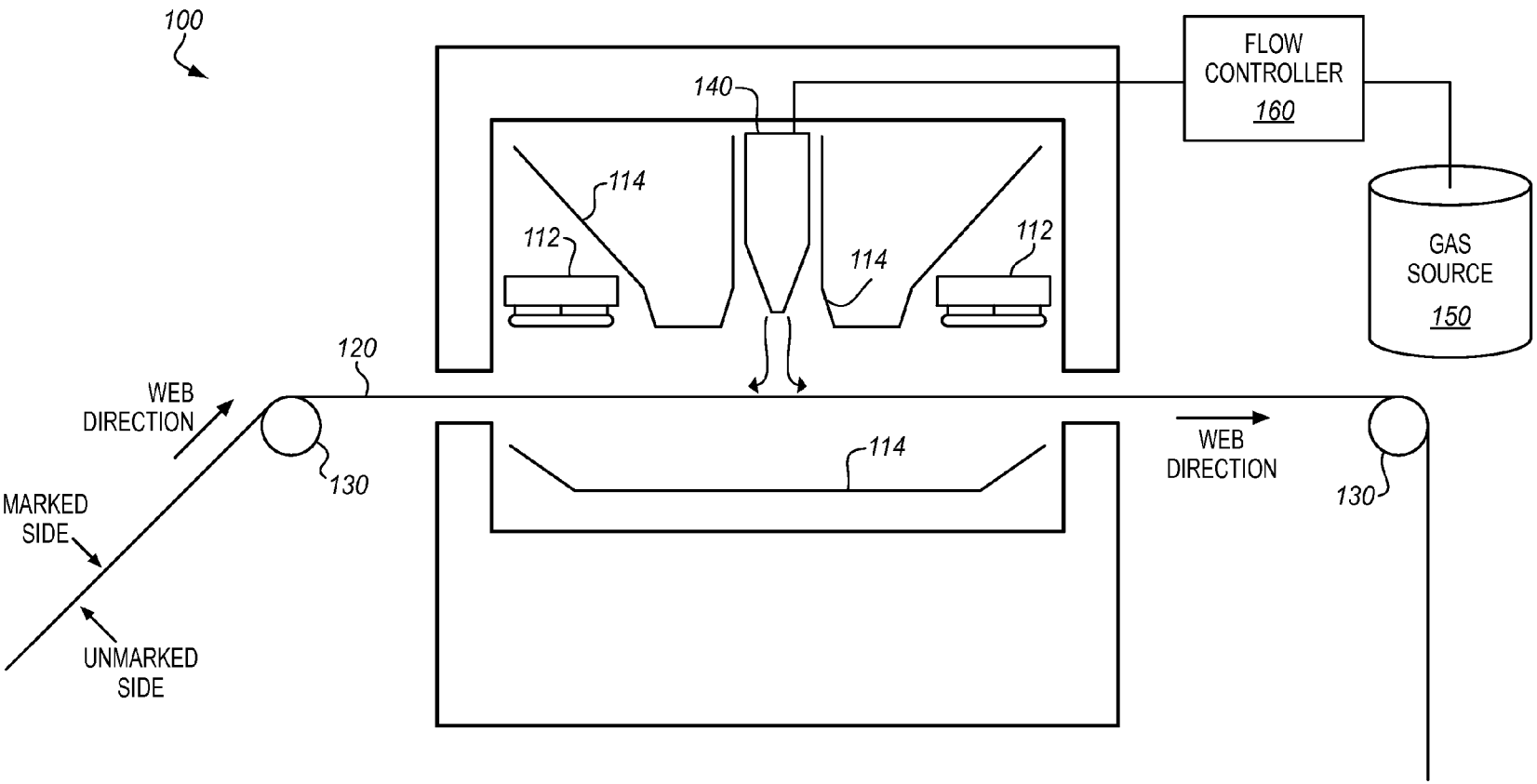
FIG. 1 is a diagram of a drying system in an exemplary embodiment.

FIG. 1 is a diagram of a drying system 100 in an exemplary embodiment. Drying system 100 receives web of printed media 120 that has been marked by an upstream marking engine and tensioned by rollers 130. Drying system 100 dries web 120 with one or more heating elements 112, such as radiant heat lamps. Radiant energy from heating elements 112 may be reflected by thermal reflectors 114 in order to reduce waste heat and also to keep drying system 100 from overheating.

Drying system 100 has been enhanced to include flow generator 140, which projects a jet of cool gas directly onto web 120 as it travels through drying system 100. The cool gas reduces temperature differences between dark (e.g., inked) and light (e.g., blank/unmarked) portions of web 120. Therefore, drying system 100 reduces the chances that marked portions of web 120 that are highly absorptive (e.g., portions marked in black or dark colors) will scorch or burn due to radiant energy applied by heating elements 112. Drying system 100 further reduces the chances that less absorptive portions (e.g., lightly colored or unmarked portions) will not adequately dry. Gas source 150 provides a supply of gas to flow generator 140, and may comprise a compressor or pressurized container. Flow controller 160 manages the rate at which gas is supplied to flow generator 140 from gas source 150. For example, flow controller 160 may comprise a manual valve. In some embodiments, flow controller 160 comprises an electronically implemented controller (e.g., a circuit, or a processor implementing programmed instructions), that is capable of actively controlling the rate at which gas travels to flow generator 140.

While specific elements are described with regard to drying system 100 of FIG. 1, the arrangement and type of elements used in FIG. 1 may vary as desired in order to dry webs of print media. For example, different numbers, arrangements, and types of each component may be used as desired.

Illustrative details of the operation of drying system 100 will be discussed with regard to FIG. 2. Assume, for this embodiment, that an upstream marking engine (e.g., an inkjet printer) has marked web 120, and that web 120 is being received at drying system 100 for processing.

Figure 2:
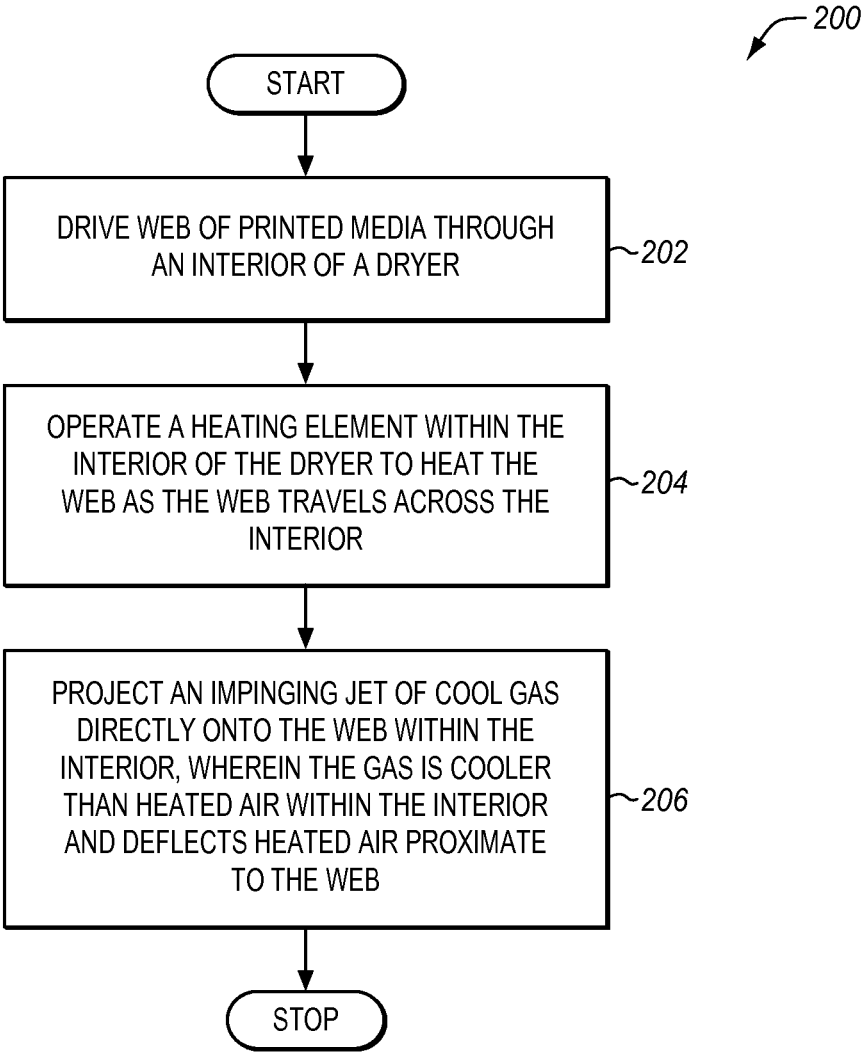
FIG. 2 is a flowchart illustrating a method for operating a drying system in an exemplary embodiment.

FIG. 2 is a flowchart illustrating a method 200 for operating a drying system in an exemplary embodiment. The steps of method 200 are described with reference to drying system 100 of FIG. 1, but those skilled in the art will appreciate that method 200 may be performed in other systems. The steps of the flowcharts described herein are not all inclusive and may include other steps not shown. The steps described herein may also be performed in an alternative order.

In step 202, web 120 is driven (e.g., by tensioned rollers 130) through an interior of drying system 100. Rollers 130 that move damp portions of web 120 may be oriented so that these damp portions do not directly contact a surface of the roller and smear.

In step 204, heating elements 112 are operated to heat web 120 as web 120 travels across the interior of drying system 100. In one embodiment, heating elements 112 are heat lamps that are electrically powered to radiate thermal energy to heat web 120.

In many drying systems, the radiant energy applied by heating elements 112 is the primary source of energy that dries web 120. However, because marked portions of print media absorb radiant energy differently than unmarked portions, web 120 can quickly experience large differences in temperature between different regions.

To address this problem, flow generator 140 projects an impinging jet of cool gas directly onto web 120 within the interior of drying system 100 in step 206. The jet of impinging gas extends into the page along the width of web 120. Because the cool gas is projected directly onto web 120, it strikes web 120 after exiting flow generator 140 without impacting any intervening surfaces within the interior of drying system 100. Furthermore, the cool gas is projected at a sufficient velocity and mass flow that it disrupts heated and saturated air proximate to web 120. This means that convective heat transfer occurs between the cool gas and web 120.

The gas projected onto web 120 is cooler than heated air within the interior (i.e., the cool gas is at ambient room temperature or is chilled to lower than ambient temperature). The cool gas may comprise air, carbon dioxide, nitrogen, argon, or any other suitable gases or combination thereof.

Method 200 therefore intentionally inserts cool gas into the heated interior of a dryer. By performing this counter-intuitive process, temperature differences between different portions of web 120 can be reduced substantially. This means that web 120 can undergo further heating within the drying system at a substantially reduced risk of ignition.

Figure 3:
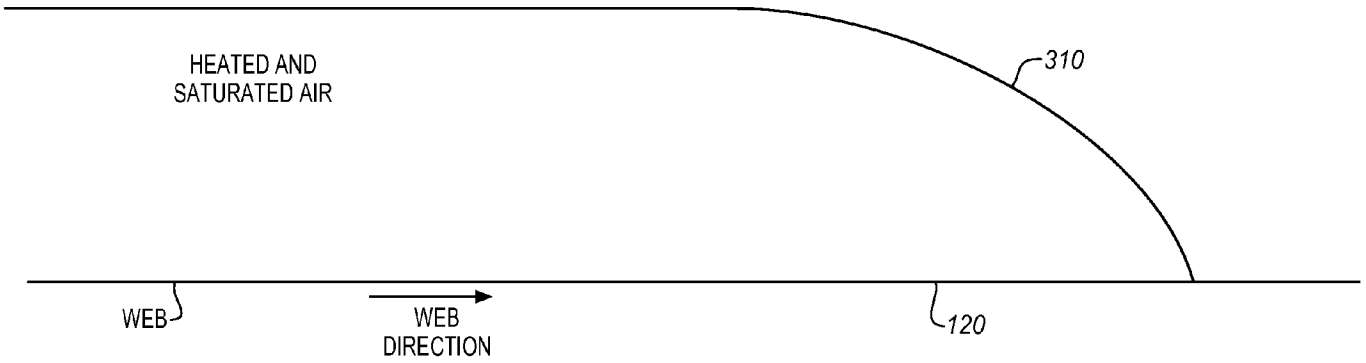
FIG. 3 is a diagram illustrating a boundary layer of heated air located proximate to a web of print media within a radiant dryer in an exemplary embodiment.
Figure 4:
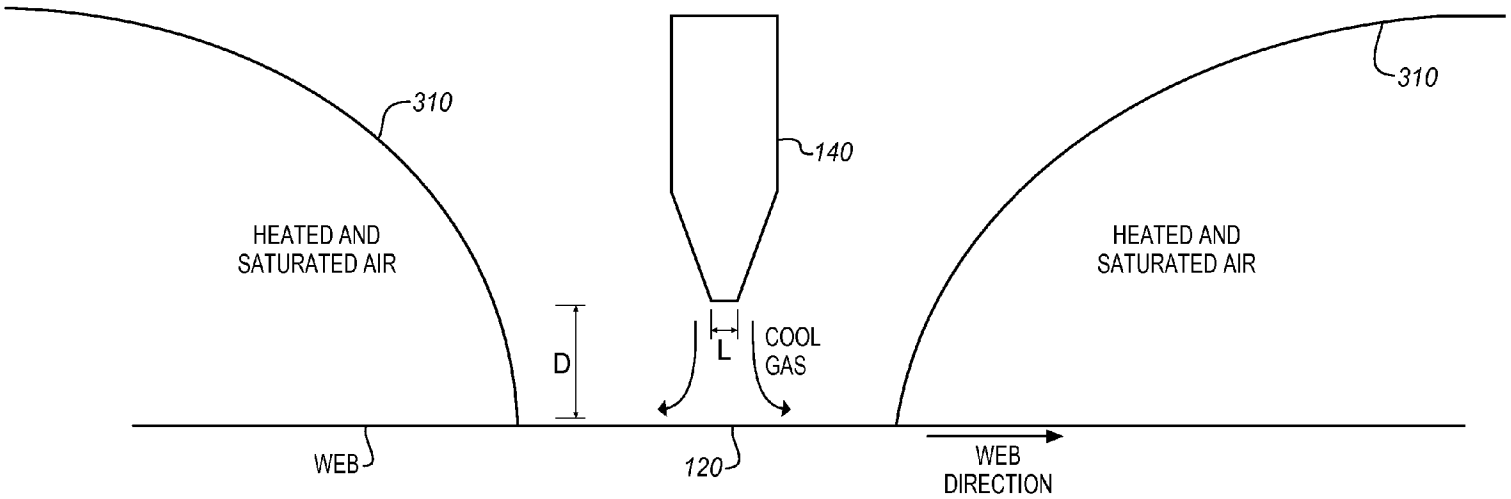
FIG. 4 is a diagram illustrating a flow generator that disrupts a boundary layer of heated air located proximate to a web of print media in an exemplary embodiment.

FIGS. 3-4 illustrate further features of cooling jets of gas within drying systems. FIG. 3 is a diagram illustrating a boundary layer of heated air 310 located proximate to a web of print media 120 within a radiant dryer in an exemplary embodiment. According to FIG. 3, web 120 is accompanied by boundary layer 310 as it travels through drying system 100. The heated air is also saturated with moisture and gaseous marking material. Because the air is saturated, the air is fairly ineffective at sapping moisture from web 120. Furthermore, because the air is heated, the air of boundary layer 310 does not provide convective heat transfer with web 120. In fact, the laminar flow of boundary layer 310 effectively insulates web 120 from convective heat transfer.

FIG. 4 is a diagram illustrating a flow generator 140 that disrupts a boundary layer of heated air 310 located proximate to a web of print media 120 in an exemplary embodiment. According to FIG. 4, cool gas projected by flow generator 140 breaks the laminar flow of boundary layer 310 at web 120. Because the cool gas breaks through boundary layer 310, which would normally insulate web 120, the cool gas engages in convective heat transfer with web 120 itself. The cool gas may therefore impact web 120 with sufficient force to create chaotic or turbulent flow at web 120.

Flow generator 140 may have a width (W) into the page that substantially matches the width of web 120. Flow generator may also have a length (L) in the direction of travel of web 120, and may be placed to have an exit nozzle located a distance D away from web 120. In one embodiment, the ratio of L to D is about 1:7. Furthermore, flow generator 140 may be oriented to strike web 120 with the jet of cool gas at a specific angle of attack with respect to web 120, and this angle of attack may be at or below ninety degrees.

Figure 5:
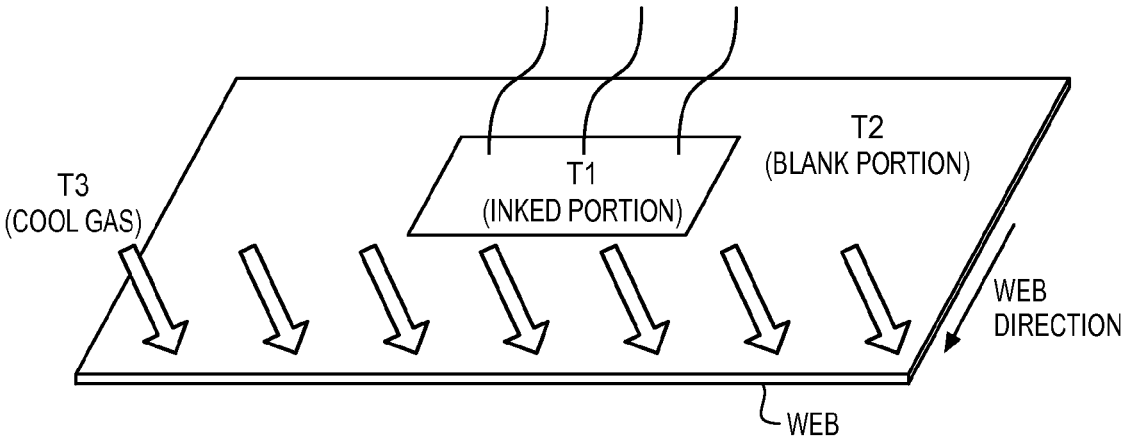
FIG. 5 is a diagram illustrating a jet of cool gas striking a web of printed media in an exemplary embodiment.
Figure 6:
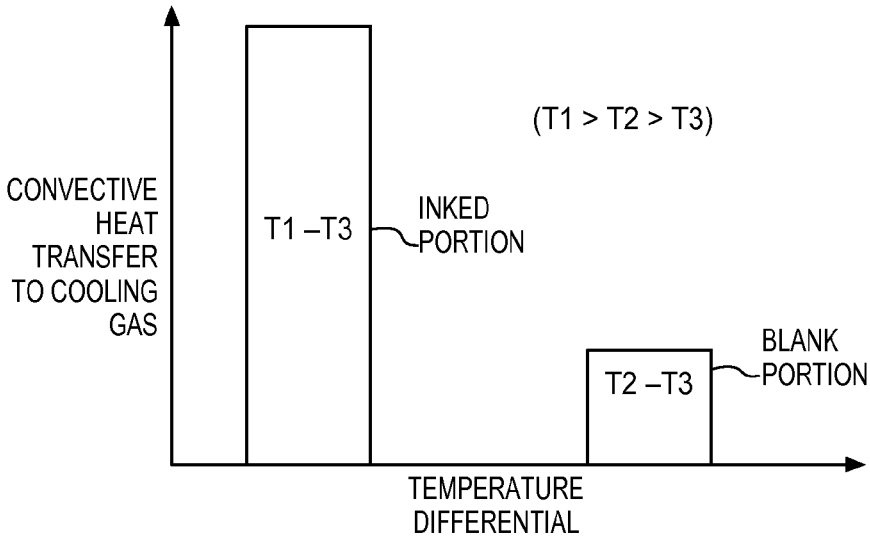
FIG. 6 is a chart illustrating heat transfer from a web of printed media to a jet of cool gas in an exemplary embodiment.

FIG. 5 is a diagram illustrating a jet of cool gas striking a web of printed media in an exemplary embodiment. According to FIG. 5, portions of the web marked with black ink are at a high temperature T1 (e.g., about 180° C.). In contrast, blank portions of the web have absorbed less radiant energy, and are at a lower temperature T2 (e.g., about 140° C.). In typical radiant dryers, at this point further heating may be dangerous, because it may risk igniting the inked portions of the web. When gas is projected onto the web at a cool temperature T3 (e.g., about 25° C.), the cool gas breaks the boundary layer of heated air surrounding the web, which means that the cool gas directly engages in convective heat transfer with the web. As the amount of convective heat transfer is a function of differences between temperatures, a larger amount of heat fluxes from the inked web to the cool gas than from the blank web to the cool gas, as illustrated in FIG. 6. This means that the temperature of the inked portion will reduce by a greater amount than the temperature of the blank portion, thereby substantially evening out the difference in temperature between the two portions to reduce the risk of scorching or burning the web. This has the further benefit of reducing the chances of warping and distortion that would otherwise be caused by differences in temperatures between these regions.

Figure 7:
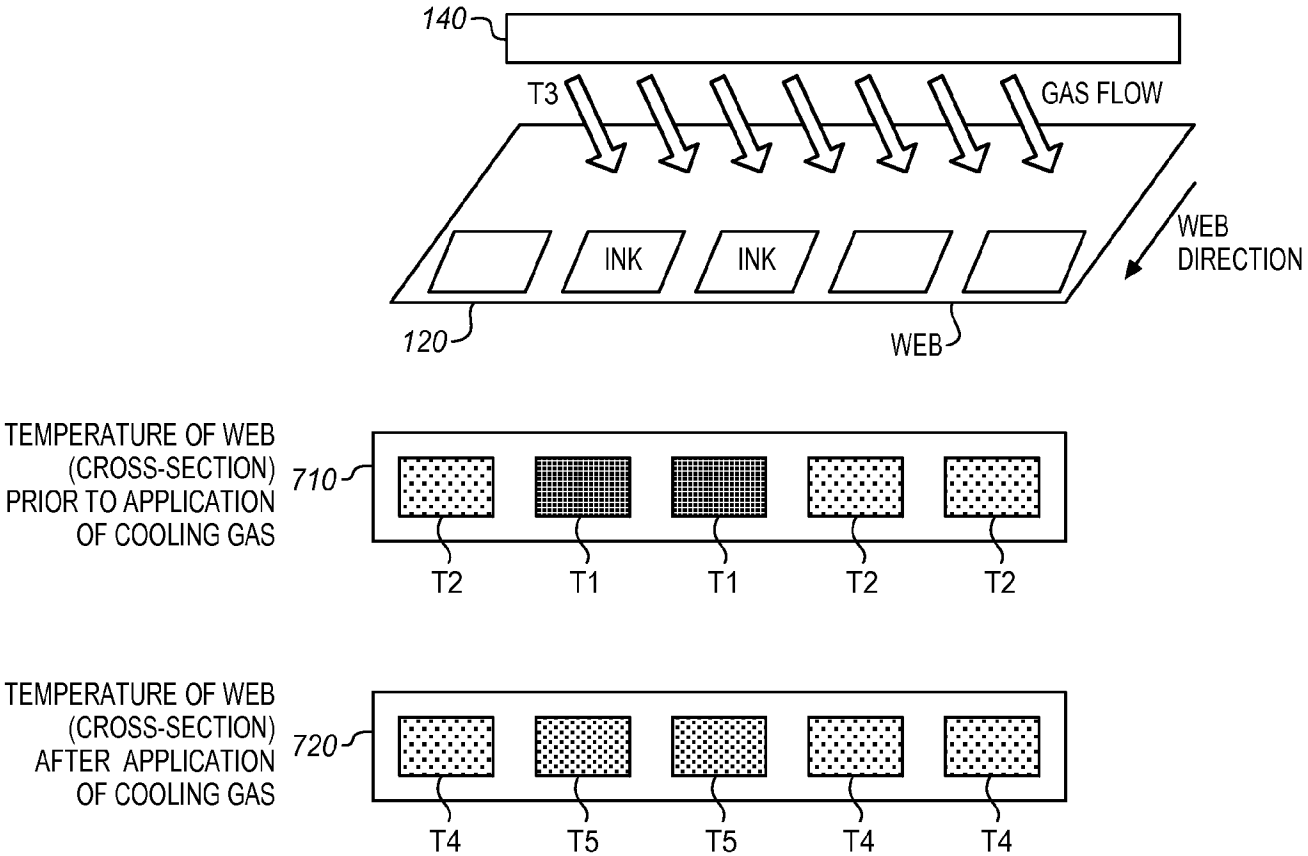
FIG. 7 is a diagram illustrating temperature differences between portions of a web of printed media before and after a cool jet of gas is applied in an exemplary embodiment.

FIG. 7 is a diagram illustrating temperature differences between inked (black) and unmarked portions of a web of printed media before and after a cool jet of gas is applied in an exemplary embodiment. FIG. 7 illustrates, in cross-section 710, that prior to application of cool gas to web 120, the black, inked portions are at a substantially higher temperature (T1, as described above) than the blank portions (T2, as described above). However, after cool gas has been applied (T3, as described above), cross-section 720 illustrates that the difference between temperatures of the inked and unmarked portions is measurably reduced (e.g., the inked portions may be reduced to about 160° C. (T5), while the unmarked portions may be reduced to about 125° C. (T4)).

Figure 8:
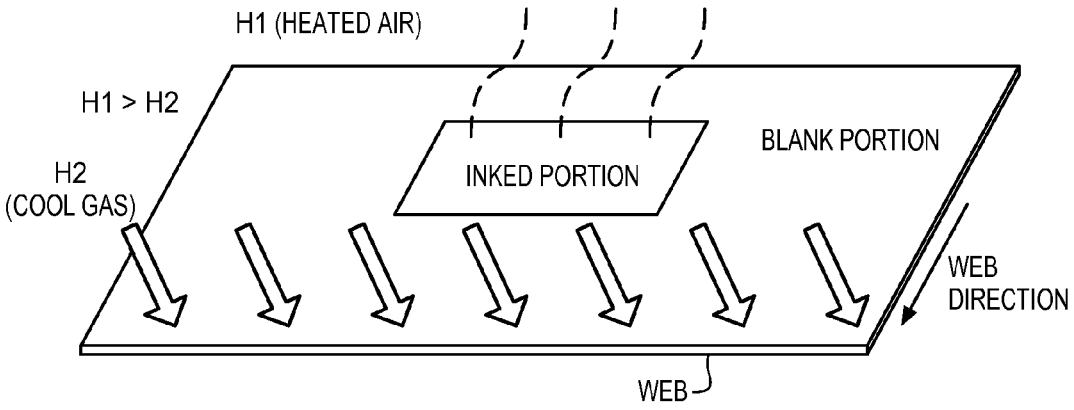
FIG. 8 is a diagram illustrating a jet of cool gas striking a web of printed media in an exemplary embodiment.
Figure 9:
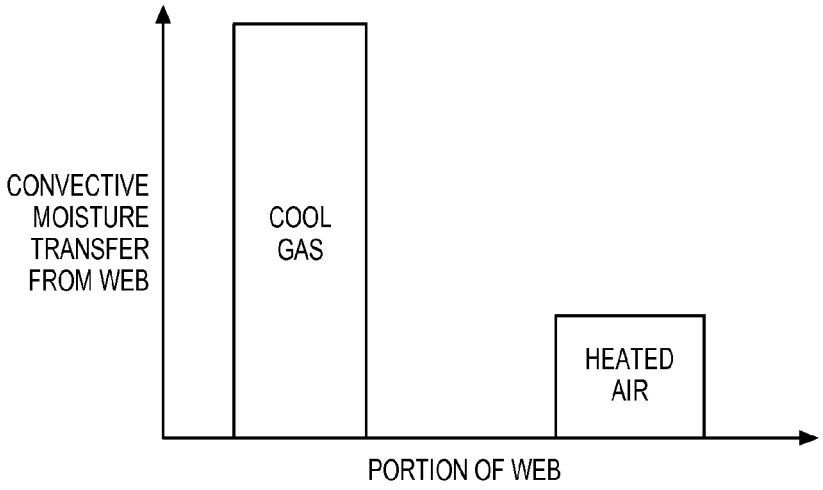
FIG. 9 is a chart illustrating moisture transfer from a web of printed media to a jet of cool gas in an exemplary embodiment.

FIG. 8 is a diagram illustrating a jet of cool gas striking a web of printed media in an exemplary embodiment. FIG. 8 illustrates concepts of mass transfer, instead of heat transfer. According to FIG. 8, saturated air just above the inked portions of the web is at a high level of humidity H1 (e.g., about 100% relative humidity). When dry, cool gas is projected onto the web at a low level of humidity H2 (e.g., about less than 50% relative humidity at 25° C.), the cool gas breaks the boundary layer of heated air surrounding the web, which means that the cool gas directly engages in convective mass transfer with the web to pick up moisture and other gaseous ink components. As the amount of convective mass transfer is a function of differences between vapor pressures, a larger amount of mass fluxes from the inked web to the cool gas than from the inked web to the heated air, as illustrated in FIG. 9. This improves the drying capabilities of the system even at a reduced temperature. This also reduces the moisture differences between portions of the web, which has the further benefit of reducing the chances of warping and distortion that would otherwise be caused by oversaturation of the printed page.

Figure 10:
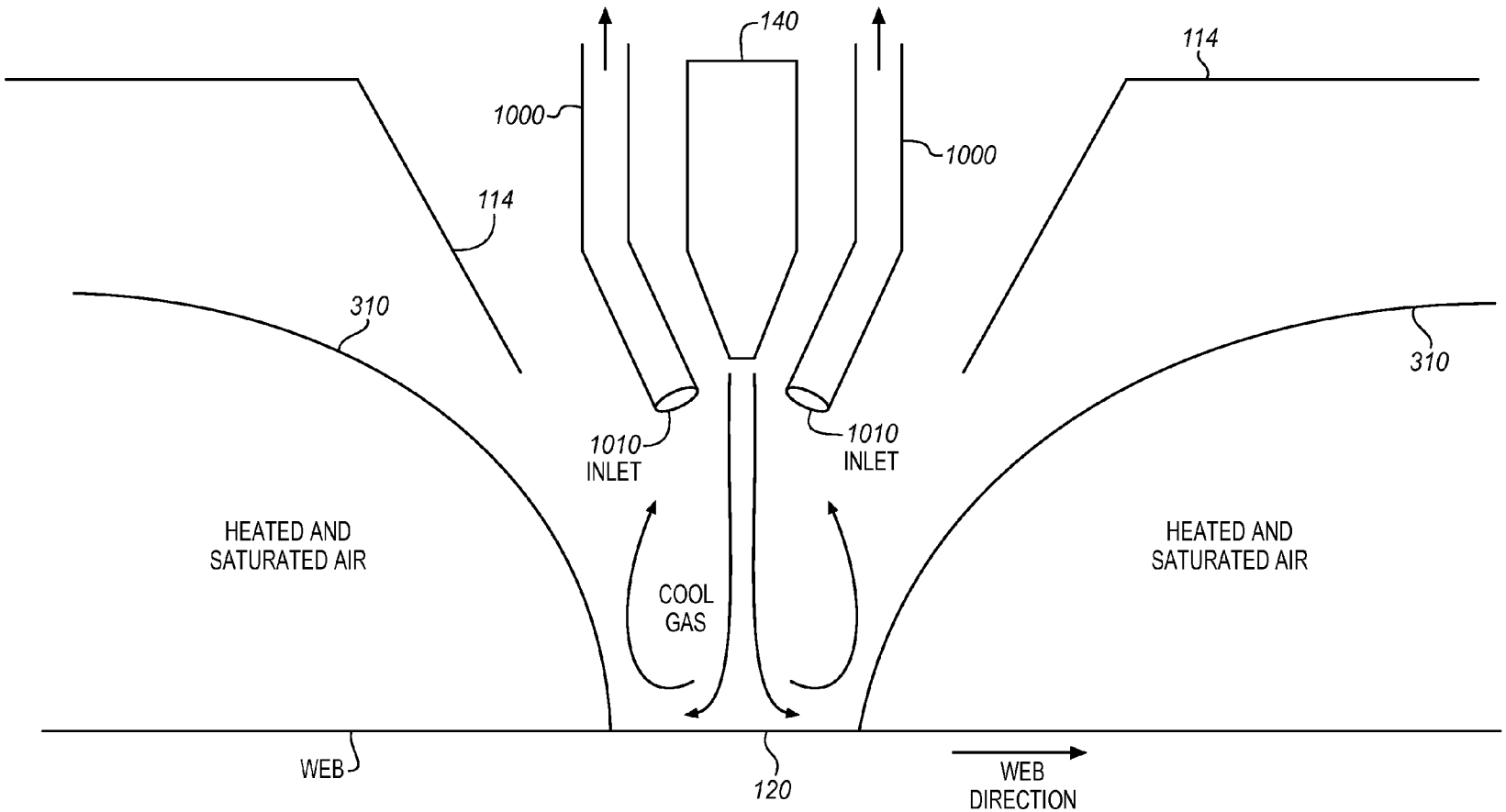
FIG. 10 is a diagram illustrating a flow generator that is thermally protected by an insulating jacket in an exemplary embodiment.

FIG. 10 is a diagram illustrating a flow generator 140 that is thermally protected by an insulating jacket 1000 in an exemplary embodiment. According to FIG. 10, flow generator 140 is placed between reflectors 114 within a drying system. The reflectors reflect radiant energy away from flow generator 140 in order to ensure that the radiant energy does not heat flow generator 140. In order to prevent heat flux from convective and conductive processes, flow generator 140 also includes thermal jacket 1000. Thermal jacket 1000 forms a thermal barrier between the cool gas in flow generator 140 and the heated air inside of the drying system. In this embodiment, thermal jacket 1000 surrounds flow generator 140, and includes an exterior shell that is filled with gas. Entrance ports such as inlets 1010 allow for gas to flow into thermal jacket 1000 and thereby reduce the temperature of thermal jacket 1000. In this embodiment, inlets 1010 are located proximate to the point at which cool gas impacts web 120. In this manner, cool gas that is deflected back toward flow generator 140 enters inlets 1010 of flow generator 140. Flow generator 140 therefore keeps itself cool by recycling gas that has already been used to convectively cool web 120. In further embodiments, thermal jacket 1000 may be integrated into airflow generator 140, and may include a thermally reflective surface.

EXAMPLES

In the following examples, additional processes, systems, and methods are described in the context of a drying system that utilizes multiple flow generators in an exemplary embodiment.

Figure 11:
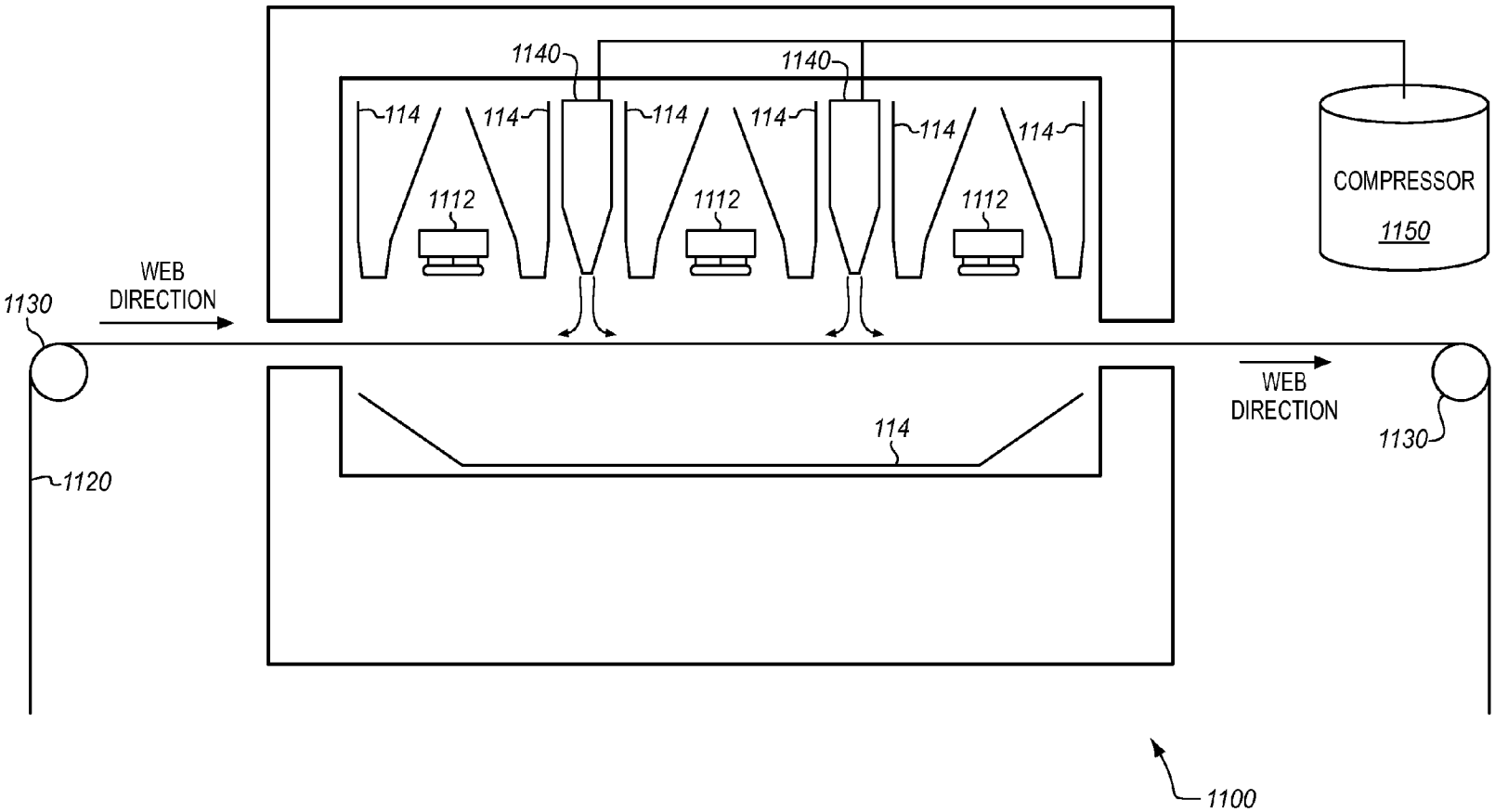
FIG. 11 is a diagram of a further exemplary drying system in an exemplary embodiment.

FIG. 11 is a diagram of a further exemplary drying system in an exemplary embodiment. According to FIG. 11, web 1120 comprises a web of paper that has been inked by an upstream continuous-forms inkjet printer and positioned by rollers 1130. The ink on web 1120 is still wet as it enters drying system 1100.

As web 1120 travels through drying system 1100 at a linear velocity of up to ten feet per second, web 1120 is alternately heated by radiant heat lamps 1112 and cooled by air knives 1140. Air knives 1140 are driven by pressure generated at compressor 1150, and air knives 1140 are protected from radiant heating by reflectors 114. Air knives 1140 project ambient temperature air at a rate of twenty feet per second onto the surface of web 1120, at a distance of twenty centimeters from the surface of web 1120. Even though the temperature of web 1120 tends to increase as it passes underneath each radiant heating element 112, the temperature differences between highly absorbing inked portions and less absorbing inked portions of web 1120 remain fairly small because of the jets of air projected by air knives 1140. This ensures that no unexpected variations in temperature will cause ignition at web 1120.

Figure 12:
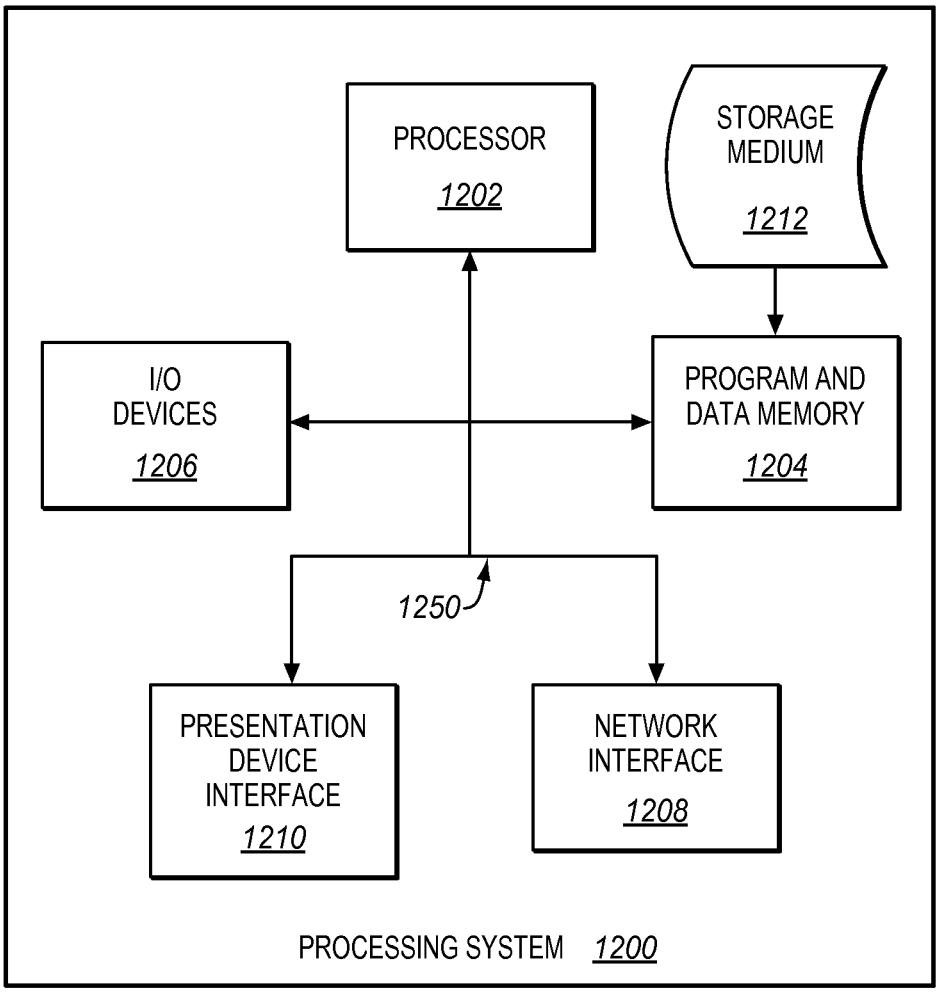
FIG. 12 illustrates a processing system operable to execute a computer readable medium embodying programmed instructions to perform desired functions in an exemplary embodiment.

In one particular embodiment, software is used to direct a processing system of flow controller 160 to dynamically regulate the amount of gas flow supplied to one or more flow generators (e.g., based on a determined speed of a web of print media). FIG. 12 illustrates a processing system 1200 operable to execute a computer readable medium embodying programmed instructions to perform desired functions in an exemplary embodiment. Processing system 1200 is operable to perform the above operations by executing programmed instructions tangibly embodied on computer readable storage medium 1212. In this regard, embodiments of the invention can take the form of a computer program accessible via computer-readable medium 1212 providing program code for use by a computer or any other instruction execution system. For the purposes of this description, computer readable storage medium 1212 can be anything that can contain or store the program for use by the computer.

Computer readable storage medium 1212 can be an electronic, magnetic, optical, electromagnetic, infrared, or semiconductor device. Examples of computer readable storage medium 1212 include a solid state memory, a magnetic tape, a removable computer diskette, a random access memory (RAM), a read-only memory (ROM), a rigid magnetic disk, and an optical disk. Current examples of optical disks include compact disk-read only memory (CD-ROM), compact disk-read/write (CD-R/W), and DVD.

Processing system 1200, being suitable for storing and/or executing the program code, includes at least one processor 1202 coupled to program and data memory 1204 through a system bus 1250. Program and data memory 1204 can include local memory employed during actual execution of the program code, bulk storage, and cache memories that provide temporary storage of at least some program code and/or data in order to reduce the number of times the code and/or data are retrieved from bulk storage during execution.

Input/output or I/O devices 1206 (including but not limited to keyboards, displays, pointing devices, etc.) can be coupled either directly or through intervening I/O controllers. Network adapter interfaces 1208 may also be integrated with the system to enable processing system 1200 to become coupled to other data processing systems or storage devices through intervening private or public networks. Modems, cable modems, IBM Channel attachments, SCSI, Fibre Channel, and Ethernet cards are just a few of the currently available types of network or host interface adapters. Presentation device interface 1210 may be integrated with the system to interface to one or more presentation devices, such as printing systems and displays for presentation of presentation data generated by processor 1202.

Although specific embodiments were described herein, the scope of the invention is not limited to those specific embodiments. The scope of the invention is defined by the following claims and any equivalents thereof.

We claim:

1. An apparatus comprising:

a dryer of a printing system;

a heating element within an interior of the dryer that is operable to apply radiant heat to a web of printed media as the web travels through the interior;

a flow generator within the interior that is operable to directly project an impinging jet of gas along a width of the web that deflects heated air proximate to the web, wherein the gas is cooler that the heated air;

a reflector that is positioned between the flow generator and the heating element and is oriented to reflect radiant heat from the heating element away from the flow generator; and an insulated jacket that surrounds an external surface of the flow generator and receives a volume of gas that insulates the external surface of the flow generator from the heated air.

2. The apparatus of claim 1 wherein:

the flow generator is supplied with the gas by a gas source that is external to the dryer.

3. The apparatus of claim 1 wherein:

the flow generator includes an exit point for the gas, the insulated jacket includes an entrance port located proximate to the location where the impinging jet deflects air from the heated web, and the entrance port receives gas deflected off of the heated web to replenish the volume.

4. The apparatus of claim 1 wherein:

the gas comprises air at a temperature below 26 degrees Celsius.

5. The apparatus of claim 1 wherein:

the flow generator comprises an air knife.

6. The apparatus of claim 1 wherein:

the flow generator projects gas with a lower moisture content than the heated air.

7. The apparatus of claim 1 wherein:

the flow generator is further operable to directly project the impinging jet of gas along a width of a marked side of the web.

8. The apparatus of claim 1 wherein:

the flow generator comprises an exit nozzle having a width substantially equal to the width of the web and a length L;

the distance from the exit nozzle to the web is D; and the ratio of L to D is substantially one to seven.

9. A method comprising:

driving a web of printed media through an interior of a dryer;

operating a heating element within the interior of the dryer to apply radiant heat to the web as the web travels through the interior;

projecting, via a flow generator within the dryer, an impinging jet of cool gas directly along a width of the web within the interior and deflecting heated air proximate to the web, wherein the gas is cooler than heated air within the interior, and wherein an insulated jacket surrounds an external surface of the flow generator and receives a volume of gas that insulates the external surface of the flow generator from the heated air; and reflecting radiant heat from the heating element away from the flow generator via a reflector positioned between the flow generator and the heating element.

10. The method of claim 9 further comprising:

supplying the flow generator with the gas from a gas source that is external to the dryer.

11. The method of claim 9 wherein:

the flow generator includes an exit point for the gas, the insulated jacket includes an entrance port located proximate to the location where the impinging jet deflects air from the heated web, and the entrance port receives gas deflected off of the heated web to replenish the volume.

12. The method of claim 9 wherein:

the flow generator comprises an air knife.

13. The method of claim 9 wherein:

the flow generator comprises an exit nozzle having a width substantially equal to the width of the web and a length L;

the distance from the exit nozzle to the web is D; and the ratio of L to D is substantially one to seven.

14. The method of claim 9 further comprising:

projecting the jet of gas as air at a temperature below 26 degrees Celsius.

15. The method of claim 9 wherein:

projecting the jet of gas at a lower moisture content than the heated air.

16. The method of claim 9 further comprising:

orienting the impinging jet of gas to directly project along a width of a marked side of the web.

17. A flow generator within a dryer, comprising:

a nozzle;

a gas source operable to force gas through the nozzle, wherein the nozzle is located within an interior of a dryer and is operable to directly project an impinging jet of cool gas along a width of a web of printed media within the dryer, wherein the gas is cooler than heated air within the interior and deflects heated air proximate to the web;

a reflector positioned between the nozzle and a heating element within the dryer, the reflector oriented to reflect radiant heat from the heating element away from the nozzle; and an insulated jacket that surrounds an external surface of the nozzle and receives a volume of gas that insulates the external surface of the nozzle from the heated air.

18. The flow generator of claim 17 wherein:

the nozzle is oriented to directly project the impinging jet of gas along a width of a marked side of the web.

* * * * *